US008695561B2

(12) United States Patent
Fujiwara

(10) Patent No.: US 8,695,561 B2
(45) Date of Patent: Apr. 15, 2014

(54) ENGINE AND STRADDLE-TYPE VEHICLE INCLUDING THE ENGINE

(75) Inventor: Hideki Fujiwara, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 1204 days.

(21) Appl. No.: 12/421,233

(22) Filed: Apr. 9, 2009

(65) Prior Publication Data

US 2009/0260595 A1 Oct. 22, 2009

(30) Foreign Application Priority Data

Apr. 16, 2008 (JP) ..... 2008-106295

(51) Int. Cl.
*F02B 75/00* (2006.01)
*F02F 7/00* (2006.01)

(52) U.S. Cl.
USPC ..... 123/195 R; 123/195 AC; 123/193.2

(58) Field of Classification Search
USPC ..... 180/228, 219, 52.1; 123/83, 195 R, 46 R, 123/465 C, 46 A, 41.72–41.81, 41.83, 41.84, 123/193.2, 195 AC
See application file for complete search history.

(56) References Cited

U.S. PATENT DOCUMENTS

| | | | | |
|---|---|---|---|---|
| 2,464,711 | A * | 3/1949 | Paxman | 123/195 R |
| 4,339,964 | A * | 7/1982 | Isaka | 74/606 R |
| 5,497,755 | A * | 3/1996 | Maloney | 123/572 |
| 6,186,099 | B1 * | 2/2001 | Tosaka et al. | 123/52.1 |
| 6,758,296 | B2 * | 7/2004 | Inaoka et al. | 180/228 |
| 6,971,362 | B2 * | 12/2005 | Gunji et al. | 123/195 R |
| 7,163,074 | B2 * | 1/2007 | Inomori et al. | 180/219 |
| 2006/0231059 | A1 | 10/2006 | Suzuki et al. | 123/197.4 |

FOREIGN PATENT DOCUMENTS

| | | | |
|---|---|---|---|
| EP | 1 477 658 | A1 | 11/2004 |
| EP | 1 826 388 | A1 | 8/2007 |
| JP | 01233189 | A * | 9/1989 |
| JP | 2004162571 | A * | 6/2004 |
| JP | 2005351261 | A * | 12/2005 |
| JP | 2006-307827 | | 11/2006 |

* cited by examiner

*Primary Examiner* — Noah Kamen
(74) *Attorney, Agent, or Firm* — Rabin & Berdo, P.C.

(57) ABSTRACT

An engine that is lighter in weight includes a crankcase, a crankshaft, a body cylinder, a head cylinder, a piston, a piston ring and a cylinder fixing bolt. The piston ring is arranged on an outer peripheral surface of the piston. One end portion of the cylinder fixing bolt extends toward the head cylinder and an other end portion of the cylinder fixing bolt extends toward the crankcase. The cylinder fixing bolt connects the head cylinder, the body cylinder and the crankcase to one another. A lower section of the body cylinder is located within the crankcase. The piston ring abuts on the lower section when the piston is located at a bottom dead center.

9 Claims, 9 Drawing Sheets

ENGINE AND STRADDLE-TYPE VEHICLE INCLUDING THE ENGINE

RELATED APPLICATIONS

This application claims the benefit of priority under 35 USC 119 of Japanese patent application no. 2008-106295, filed on Apr. 16, 2008, which is hereby incorporated by reference.

BACKGROUND OF THE INVENTION

1. Field of the Invention

The present invention relates to an engine and a straddle-type vehicle including the engine.

2. Description of Related Art

FIG. 9 is a cross-sectional view of a typical engine 100 as disclosed in Japanese Patent Application Laid-Open No. 2006-307827. The engine 100 includes a crankcase 101, a body cylinder 102 and a head cylinder 103. As shown in FIG. 9, a piston ring 105 of a piston 104 is normally and always located at a higher position than a position of the crankcase 101. Even when the piston 104 reaches a bottom dead center, the piston ring 105 is located at a position higher than that of the crankcase 101. Due to this, it is necessary to set a length of an upper section 102*a* that belongs in a head cylinder 103 and is located at a higher position than that of the crankcase 101 to be larger than a stroke length of the piston 104.

Meanwhile, the head cylinder, body cylinder and crankcase are generally joined integrally by a bolt. Therefore, if the distance between the head cylinder and the crankcase is long, as seen in FIG. 9, a longer bolt is required. The engine tends to increase in weight as the bolt is longer.

SUMMARY OF THE INVENTION

The present invention addresses these issues and provides an engine that is lighter in weight.

An engine according to the present invention comprises a crankshaft accommodated in a crankcase. A connecting rod is connected to the crankshaft. A piston is connected to a tip end portion of the connecting rod. A piston ring is attached to an outer peripheral surface of the piston. A body cylinder is connected to the crankcase and includes a cylinder section inside of which the piston is displaced. A head cylinder is connected to a tip end portion of the body cylinder. A cylinder fixing bolt has one end portion extending toward the head cylinder and an other end portion extending toward the crankcase. The cylinder fixing bolt connects the head cylinder, the body cylinder and the crankcase to one another. The cylinder section of the body cylinder includes a lower section located within the crankcase and an upper section located at a higher position than that of the crankcase. The piston ring abuts on the lower section when the piston is located at a bottom dead center.

A vehicle according to the present invention includes the engine according to the present invention.

The present invention decreases the weight of the engine.

Other features and advantages of the invention will be apparent from the following detailed description, taken in conjunction with the accompanying drawings that illustrate, by way of example, various features of embodiments of the invention.

DETAILED DESCRIPTION OF THE INVENTION

Figure 1:
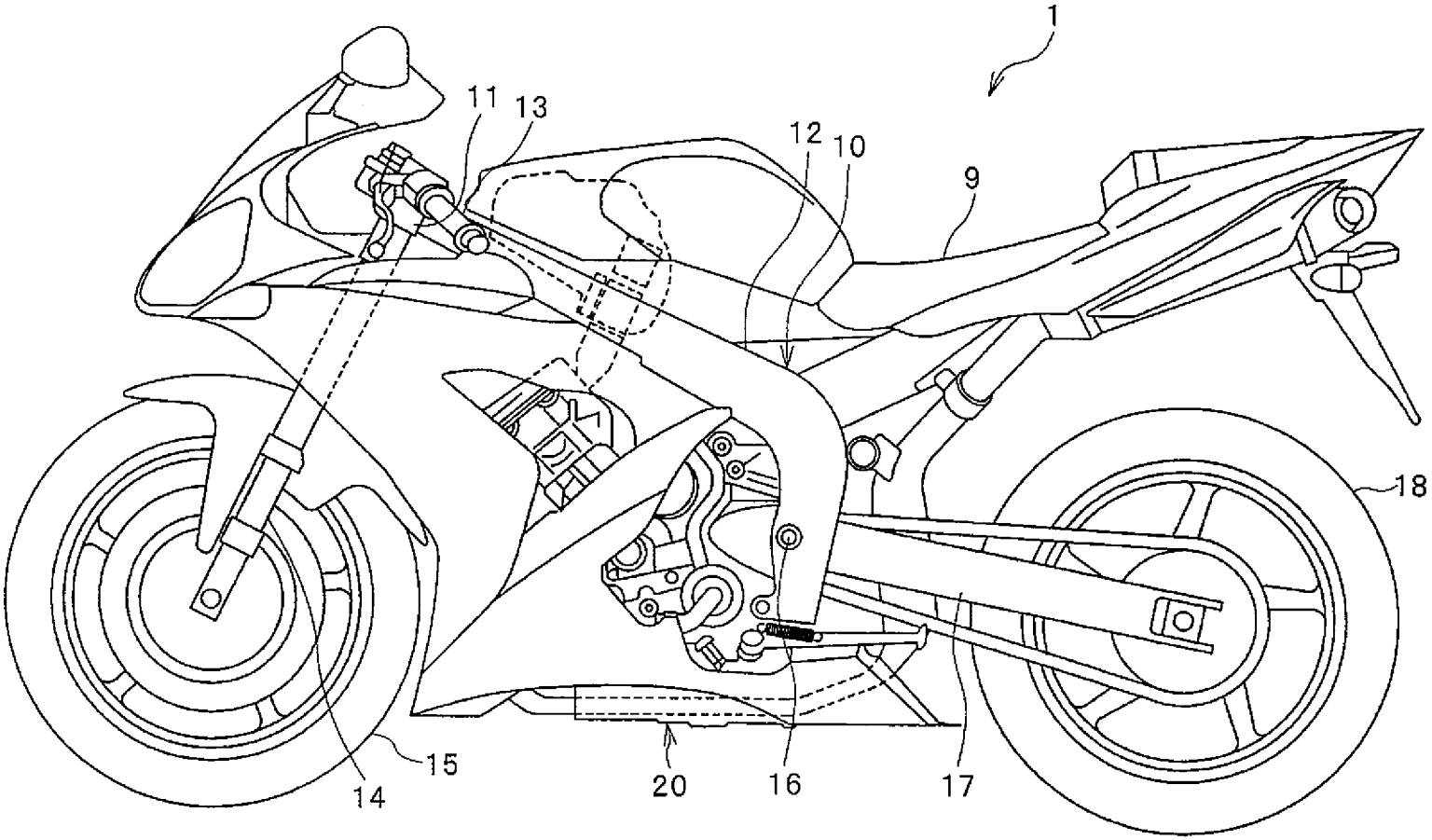
FIG. 1 is a left side view of a motorcycle according to an embodiment of the present invention.

A straddle-type vehicle according to an embodiment of the present invention is now described in detail using motorcycle 1 of FIG. 1 as an example. In the following description, the front-back and left-right directions are from the perspective of a rider seated on a seat 9.

In the present invention, a "straddle-type vehicle" is a vehicle that a rider rides by straddling a seat (saddle) of the vehicle. Examples include a motorcycle, an ATV (All Terrain Vehicle) and a snowmobile. In the present invention, a "motorcycle" is a motorcycle in a broad sense including not only a motorcycle in a narrow sense but also, for example, a moped, an off-road vehicle and a scooter. Therefore, a straddle-type vehicle according to the present invention is not limited to the motorcycle 1 in a narrow sense shown in FIG. 1 and may be a moped, an off-road vehicle, a scooter or the like. In addition, a straddle-type vehicle according to the present invention may be another vehicle such as an ATV or a snowmobile, or a vehicle having at least one front wheel and a plurality of rear wheels, and that is tilted to change a traveling direction.

(Schematic Configuration of Motorcycle 1)

FIG. 1 is a left side view of the motorcycle 1 according to a first embodiment of the present invention. As shown in FIG. 1, the motorcycle 1 includes a body frame 10. The body frame 10 includes a head pipe 11 arranged in a front portion of motorcycle 1 and a main frame 12 extending from the head pipe 11 obliquely rearward and downward.

A steering shaft is rotatably inserted into the head pipe 11. A handle 13 and a pair of front forks 14 are connected to the steering shaft. A front wheel 15 is rotatably attached to lower end portions of the front forks 14. A pivot shaft 16 is attached to a rear portion of the main frame 12. A rear arm 17 is pivotally attached to the pivot shaft 16. A rear wheel 18 is rotatably attached to a rear end portion of the rear arm 17.

(Engine 20)

Figure 2:
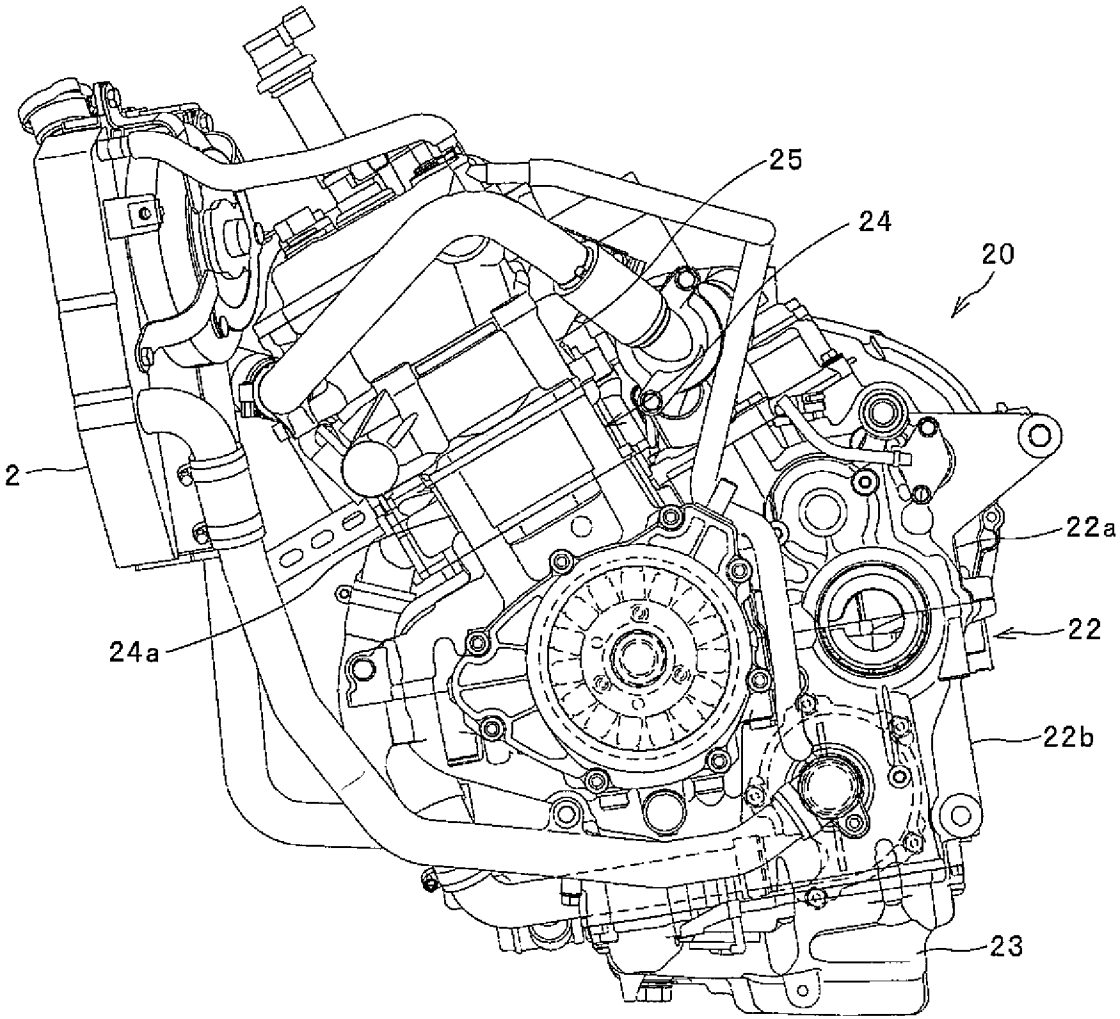
FIG. 2 is a left side view of the motorcycle.

An engine 20 serving as a power source is suspended on the main frame 12. As shown in FIG. 2, a radiator 2 is arranged in front of the engine 20. In this embodiment, the engine 20 is a transverse multiple-cylinder engine, specifically, a water-cooled transverse four-cylinder engine. However, engine 20 is not limited to a specific type and may be, for example, a transverse two-cylinder engine, a transverse three-cylinder engine or a transverse five or more-cylinder engine. Furthermore, the engine may be, for example, a single-cylinder engine, an in-line multiple-cylinder engine, a horizontallyopposed multiple-cylinder engine or a V-type multiple-cylinder engine. The engine may be of an air-cooled type.

Figure 3:
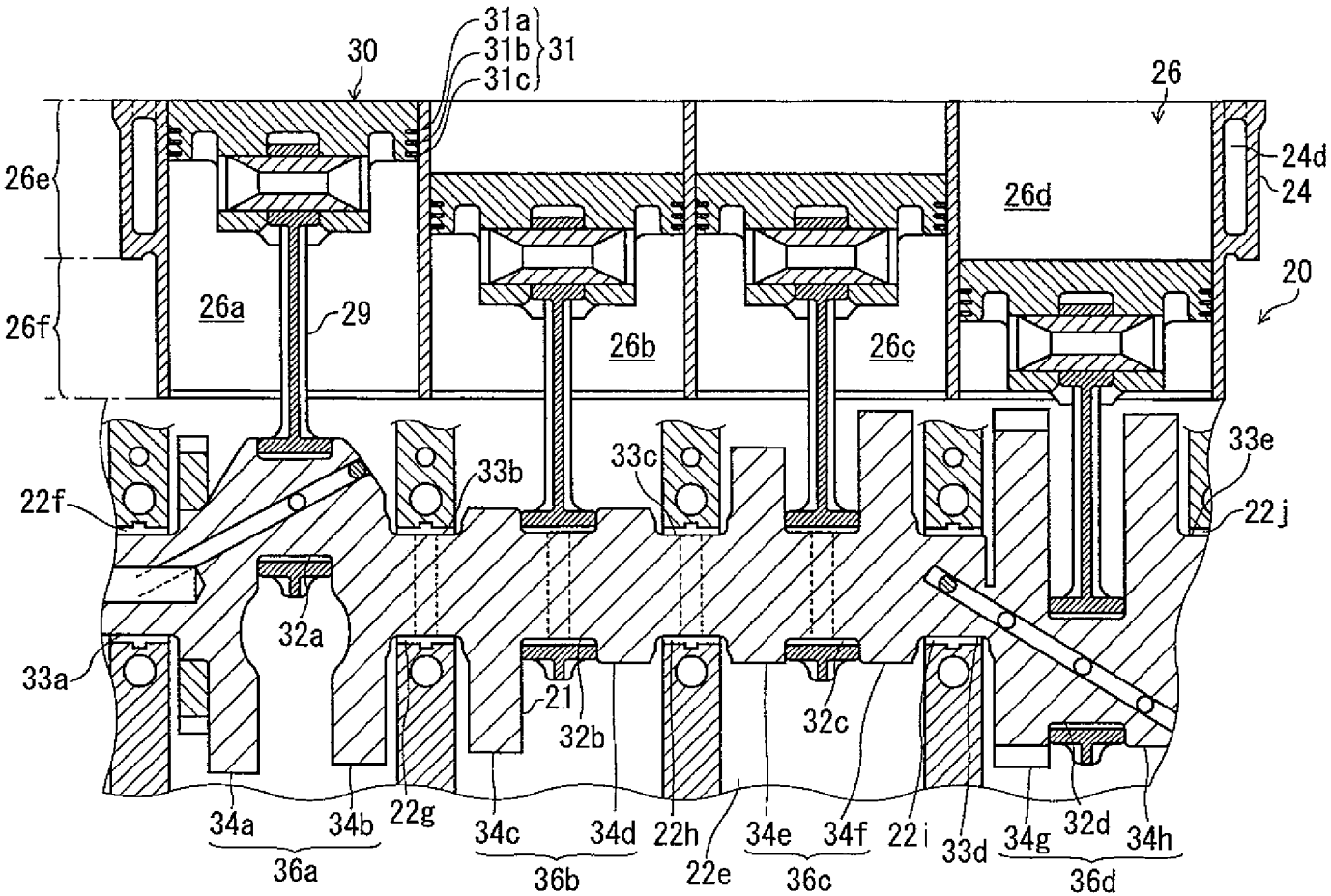
FIG. 3 is a cross-sectional view of a part of the engine.

The engine 20 includes a crankshaft 21 (FIG. 3) that extends in a vehicle width direction and is accommodated in a crankcase 22 (FIG. 2). As shown in FIG. 3, the crankshaft 21 includes a first crank web pair 36*a*; a second crank web pair 36*b*; a third crank web pair 36*c*; and a fourth crank web pair 36*d*, a first crank pin 32*a*; a second crank pin 32*b*; a third crank pin 32*c*; and a fourth crank pin 32*d*, and a first crank journal 33*b*; a second crank journal 33*c*; a third crank journal 33*d*; a fourth crank journal 33*a*; and a fifth crank journal 33*e*.

The first crank web pair 36*a* is arranged on a leftmost side in FIG. 3 and includes a first crank web 34*a* and a second crank web 34*b*. The second crank web 34*b* is arranged at the right of the first crank web 34*a* in the vehicle width direction. The first crank web 34*a* and the second crank web 34*b* are connected to each other by the first crank pin 32*a* extending in the vehicle width direction. The fourth crank journal 33*a* is arranged at the left of the first crank web 34*a* in the vehicle width direction. The first crank web 34*a* is connected to the fourth crank journal 33*a*. The fourth crank journal 33*a* is supported by a first bearing section 22*f* formed in the crankcase 22.

The second crank web pair 36*b* is arranged at the right of the first crank web pair 36*a* in the vehicle width direction and includes a third crank web 34*c* and a fourth crank web 34*d*. The third crank web 34*c* is arranged at the right of the second crank web 34*b* in the vehicle width direction. The third crank web 34*c* is connected to the second crank web 34*b* by the first crank journal 33*b*. The first crank journal 33*b* is supported by a second bearing section 22*g* formed in the crankcase 22. The fourth crank web 34*d* is arranged at the right of the third crank web 34*c* in the vehicle width direction. The third crank web 34*c* and the fourth crank web 34*d* are connected to each other by the second crank pin 32*b* extending in the vehicle width direction.

The third crank web pair 36*c* is arranged at the right of the second crank web pair 36*b* in the vehicle width direction and includes a fifth crank web 34*e* and a sixth crank web 34*f*. The fifth crank web 34*e* is arranged at the right of the fourth crank web 34*d* in the vehicle width direction. The fifth crank web 34*e* and the fourth crank web 34*d* are connected to each other by the second crank journal 33*c* extending in the vehicle width direction. The second crank journal 33*c* is supported by a third bearing section 22*h* formed in the crankcase 22. The sixth crank web 34*f* is arranged at the right of the fifth crank web 34*e* in the vehicle width direction. The sixth crank web 34*f* and the fifth crank web 34*e* are connected to each other by the third crank pin 32*c* extending in the vehicle width direction.

The fourth crank web pair 36*d* is arranged at the right of the third crank web pair 36*c* in the vehicle width direction and includes a seventh crank web 34*g* and an eighth crank web 34*h*. The seventh crank web 34*g* is arranged at the right of the sixth crank web 34*f* in the vehicle width direction. The seventh crank web 34*g* and the sixth crank web 34*f* are connected to each other by the third crank journal 33*d* extending in the vehicle width direction. The third crank journal 33*d* is supported by a fourth bearing section 22*i* formed in the crankcase 22. The eighth crank web 34*h* is arranged at the right of the seventh crank web 34*g* in the vehicle width direction. The eighth crank web 34*h* and the seventh crank web 34*g* are connected to each other by the fourth crank pin 32*d* extending in the vehicle width direction.

The fifth crank journal 33*e* is arranged at the right of the eighth crank web 34*h* in the vehicle width direction. The eighth crank web 34*h* is connected to the fifth crank journal 33*e*. The fifth crank journal 33*e* is supported by a fifth bearing section 22*j* formed in the crankcase 22.

The crankcase 22 includes an upper casing section 22*a* and a lower casing section 22*b*. The lower casing section 22*b* is arranged below the upper casing section 22*a*. A crank chamber 22*e*, which accommodates the crankshaft 21 and is shown in FIG. 3, is divided by the upper casing section 22*a* and the lower casing section 22*b*.

An opening portion open downward is formed in the lower casing section 22*b*. As shown in FIG. 2, an oil pan 23 is attached to this opening portion of the lower casing section 22*b*.

An opening portion 22*c* (FIG. 5) is formed in a first half part of the upper casing section 22*a*. A body cylinder 24 (FIG. 2) is attached above the opening portion 22*c*. A head cylinder 25 (e.g., a cylinder head) is attached to an upper end portion of the body cylinder 24.

As shown in FIG. 3, the body cylinder 24 includes a plurality of cylinder sections 26. Specifically, the body cylinder 24 includes a first cylinder section 26*a*, a second cylinder section 26*b*, a third cylinder section 26*c* and a fourth cylinder section 26*d*. These four cylinder sections 26*a*-26*d* are arranged in the vehicle width direction. In this specification, a "cylinder section" is a section in which a substantially cylindrical space where a piston is displaced is formed. Generally, a body cylinder is formed by one cylinder section or a group of plural cylinder sections.

Figure 4:
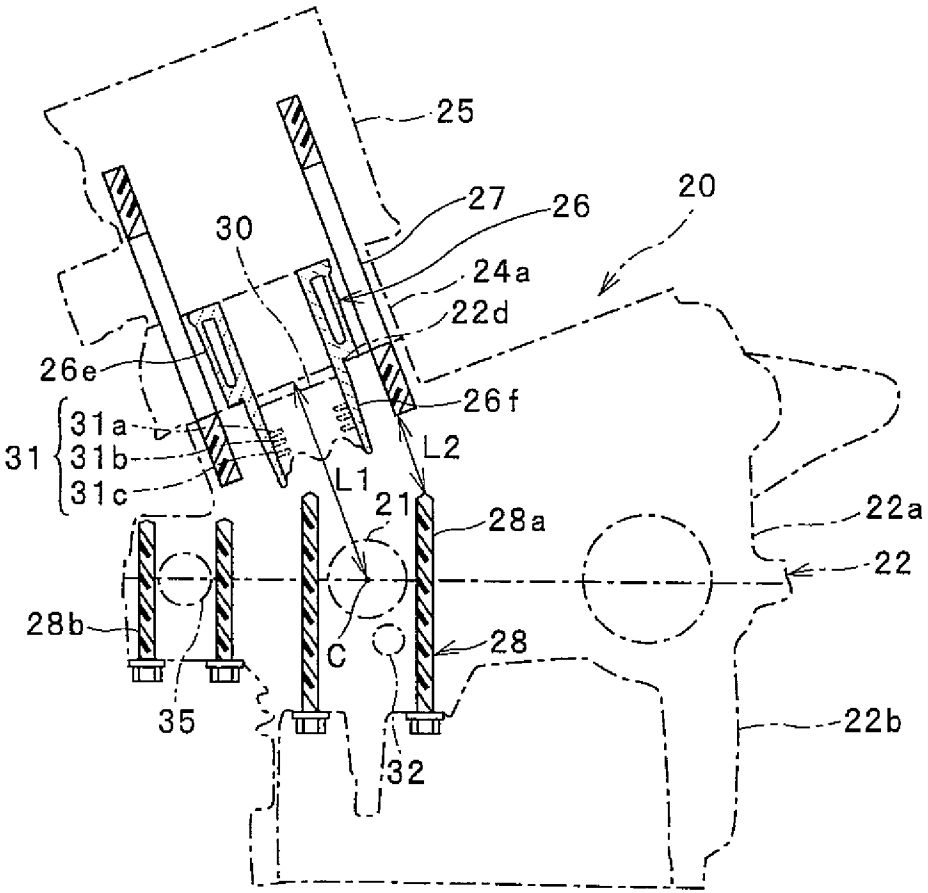
FIG. 4 is a schematic left side view of the engine for explaining fixed states of a crankcase, a body cylinder and a head cylinder.

Each of the cylinder sections 26*a*-26*d* includes an upper section 26*e* and a lower section 26*f*. As shown in FIG. 4, the lower section 26*f* is located within the crankcase 22. The upper section 26*e* is arranged at a higher position than a position of the crankcase 22. A lower end portion 26*g* of the upper section 26*e* shown in FIG. 6 abuts on a seat surface 22*d* of the upper casing section 22*a* shown in FIG. 5. A piston 30 indicated by a chain line in FIG. 4 is located at a bottom dead center. A crankpin 32 indicated by a chain line is a crankpin when the piston 30 is located at the bottom dead center.

In FIG. 4, the cylinder section 26, the piston 30 and the piston ring 31 are drawn to make clearer positional relation among the cylinder section 26, the piston 30, the piston ring 31, the crankcase 22 and the like. Specifically, in FIG. 4, the cylinder section 26, the piston 30 and the piston ring 31 are reduced in size in a direction perpendicular to an axis of the cylinder section 26 so that the cylinder member 26 is not overlapped with a cylinder fixing bolt 27.

Figure 6:
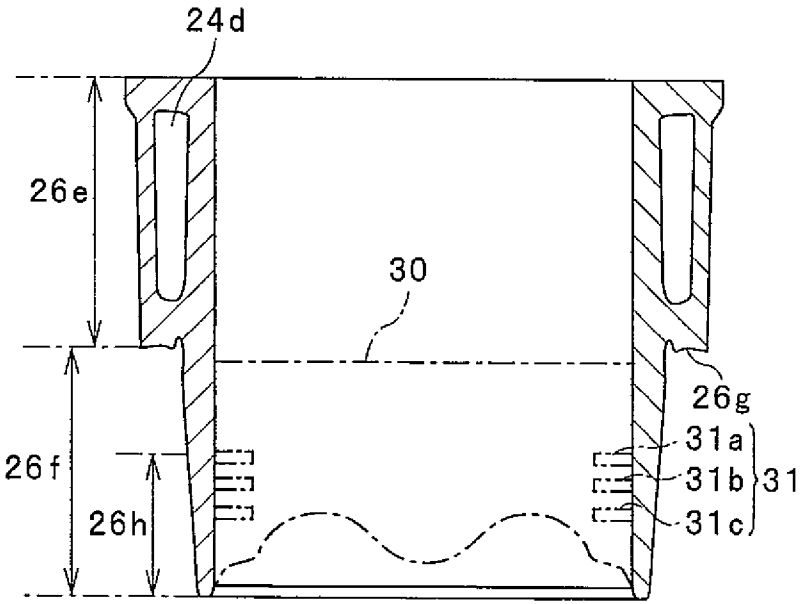
FIG. 6 is a cross-sectional view of the body cylinder showing a piston when located at a bottom dead center.

As shown in FIG. 6, the upper section 26*e* is thicker than the lower section 26*f*. A water jacket 24*d* to which cooling water is supplied is formed from an upper end portion to a lower end portion of the upper section 26*e* in an extension direction of a center axis of the cylinder section 26.

A tapered section 26*h* is formed in a portion downward of a center of the lower section 26*f* and becomes thinner in a downward direction. Tapered section 26*h* is arranged toward the crankshaft 21 as compared with the piston ring 31 of the piston 30 located at the bottom dead center. The tapered section 26*h* is thinner than a portion of the lower section 26*f* located opposite to the crankshaft 21 with respect to the piston ring 31 of the piston 30 located at the bottom dead center.

As shown in FIG. 3, a slidably displaceable piston 30 is arranged in each of the cylinder sections 26*a*-26*d*. The piston 30 is connected to a tip end portion of a connecting rod 29. A proximal end portion of the connecting rod 29 is connected to the crankshaft 21.

As shown in FIGS. 3 and 6, a plurality of piston rings 31 are arranged on an outer peripheral surface of the piston 30. Specifically, a first piston ring 31*a*, a second piston ring 31*b*, and a third piston ring 31*c* are arranged on the outer peripheral surface of the piston 30. These piston rings 31 keep a combustion chamber airtight.

As shown in FIG. 4, the head cylinder 25, the body cylinder 24 and the upper casing section 22*a* are fixed to one another by a plurality of cylinder fixing bolts 27. In the present embodiment, each of the cylinder fixing bolts 27 is constituted by a stud bolt having screw holes formed on both ends.

Figure 5:
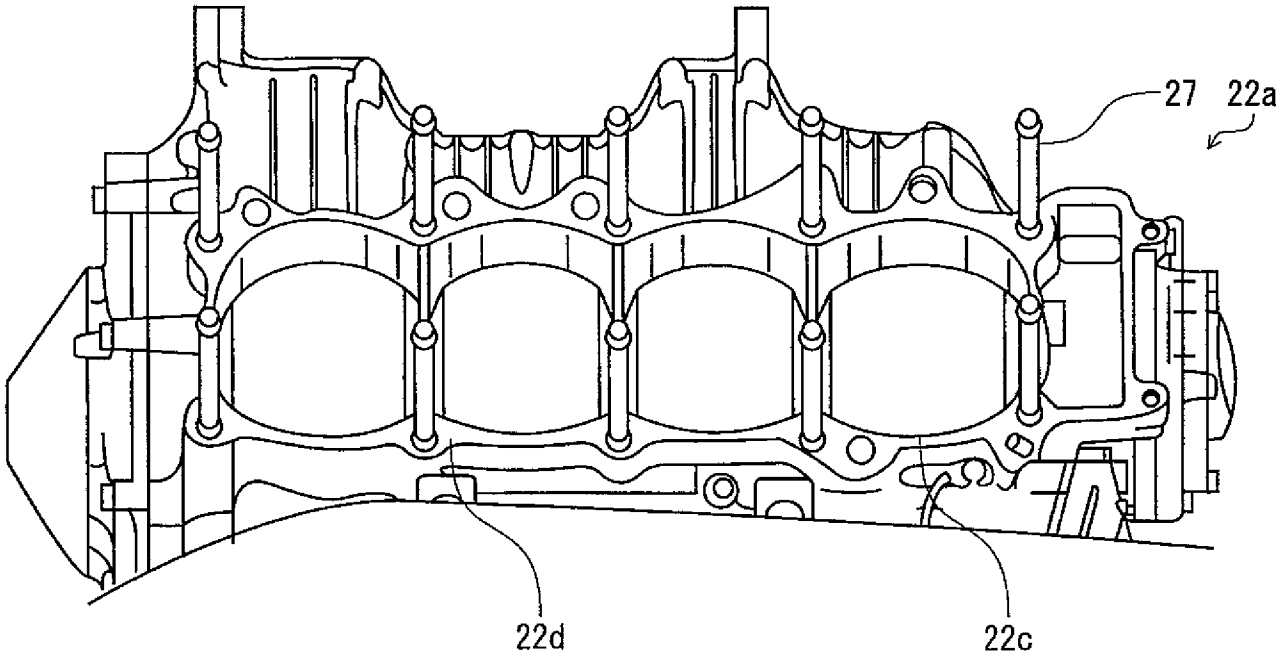
FIG. 5 is a plan view of a front portion of an upper casing section of the crankcase.

As shown in FIG. 5, ten cylinder fixing bolts 27 are arranged in total at the left side of the first cylinder section 26*a*, at the right side of the fourth cylinder section 26*d*, and between the cylinder sections 26*a* to 26*b*; that is, in front of and in rear of each cylinder section 26.

As shown in FIG. 4, an upper end of each of the cylinder fixing bolts 27 extends toward the head cylinder 25, and a lower end portion of each of the cylinder fixing bolts extends toward the upper casing section 22*a*. Each of the cylinder fixing bolts 27 is screwed with the head cylinder 25 and the upper casing section 22*a*.

The upper casing section 22*a* and the lower casing section 22*b* are fixed to each other by casing fixing bolts 28. The casing fixing bolts 28 include first casing fixing bolts 28*a* arranged in front of and in rear of the crankshaft 21, and second casing fixing bolts 28 arranged in front of and in rear of a balancer shaft 35.

As shown in FIG. 4, the cylinder section 26 reaches up to an interior of the crankcase 22. In the present embodiment, when the piston 30 is located at the bottom dead center, the piston ring 31 abuts on the lower section 26*f*. In other words, when the piston 30 reaches the bottom dead center, the piston ring 31 is located within the crankcase 22. More specifically, when the piston 30 reaches the bottom dead center, the overall piston 30 is substantially located within the crankcase 22. Namely, a sliding section that belongs in the body cylinder 24 and slides with respect to the piston 30 reaches up to the interior of the crankcase 22.

Figure 7:
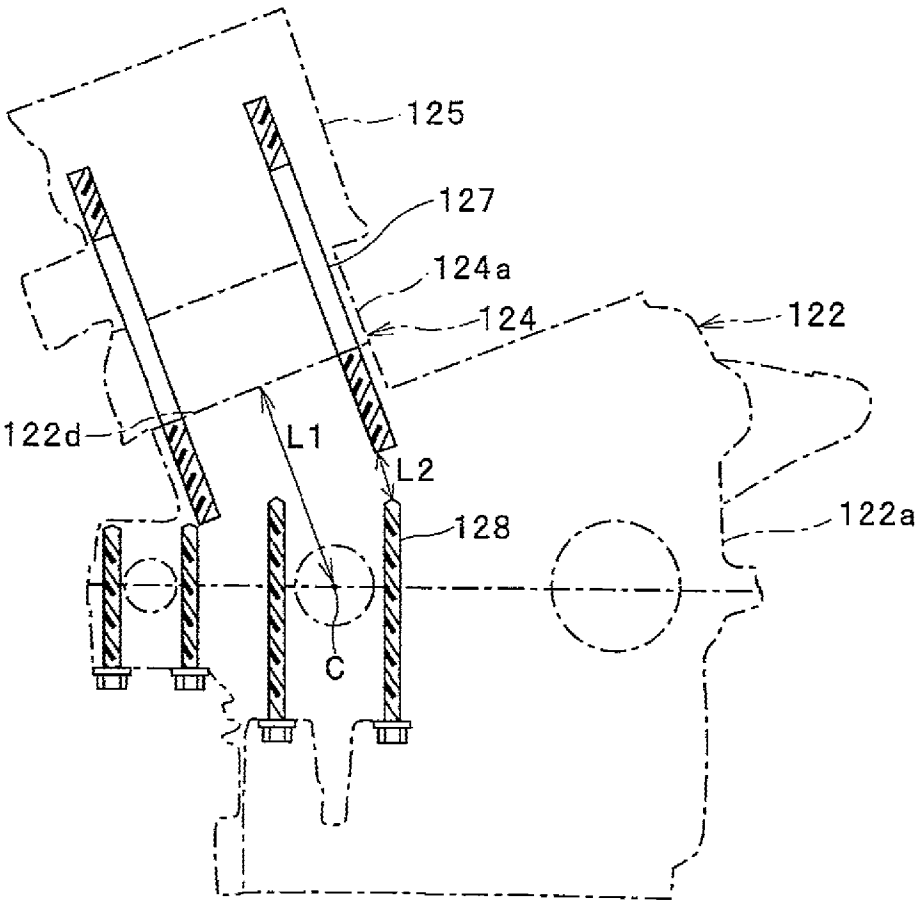
FIG. 7 PRIOR ART
FIG. 7 is a schematic left side view of the engine in which a sliding section that belongs in the body cylinder and slides with respect to the piston is located at a higher position than a position of the crankcase.

Conventionally, a sliding section that belongs in a body cylinder and slides with respect to a piston is normally provided at a higher position than a position of a crankcase. Due to this, as shown in FIG. 7, an upper section 124*a* of a body cylinder 124 located above a crankcase 122 is relatively long in a direction of a center axis of a cylinder. Accordingly, a distance between the upper casing section 122*a* of the crankcase 122 and a head cylinder 125 is relatively long. It is, therefore, necessary to set each cylinder fixing bolt 127 to be relatively long.

According to the present embodiment, by contrast, when the piston 30 is located at the bottom dead center, the piston ring 31 abuts on the lower section 26*f* as shown in FIGS. 3 and 6. Namely, the sliding section that belongs in the body cylinder 24 and slides with respect to the piston 30 reaches up to the lower section 26*f* located within the crankcase 22. A length of the upper section 26*e* located at the higher position than the position of the crankcase 22 in the direction of the center axis of the cylinder section 26 can thereby be made smaller than a stroke length of the piston 30. Accordingly, as shown in FIG. 4, a distance between the head cylinder 25 and the crankcase 22 can be made shorter. As a result, the length of the cylinder fixing bolt 27 can be made shorter, as compared with the case shown in FIG. 7, and engine 20 can be decreased in weight.

As shown in FIG. 4, according to the present embodiment, the crankcase 22 includes the upper casing section 22*a* and the lower casing section 22*b* that are connected to each other by the casing fixing bolts 28 extending vertically. Each of the cylinder fixing bolts 27 and each of the casing fixing bolts 28 are thereby arranged to be relatively proximate to each other.

For example, if the sliding section that belongs in the body cylinder 124 and slides with respect to the piston is located at a higher position than that of the crankcase 122 as shown in FIG. 7, a distance L1 between the axis C of the crankshaft and a seat surface 122*d* of the upper casing section 122*a* is relatively short. A distance L2 between each cylinder fixing bolt 127 and each casing fixing bolt 128 is thereby relatively short. Accordingly, a high stress is applied onto a portion that belongs in the crankcase 122 and is located between a lower end portion of the cylinder fixing bolt 127 and an upper end portion of the casing fixing bolt 128. It is therefore necessary, for example, to increase the thickness of the portion that belongs in the crankcase 122 and is located between the lower end portion of the cylinder fixing bolt 127 and the upper end portion of the casing fixing bolt 128. However, if the thickness of the portion that belongs in the crankcase 122 and is located between the lower end portion of the cylinder fixing bolt 127 and the upper end portion of the casing fixing bolt 128 is increased, the crankcase 122 tends to increase in weight. Accordingly, the engine 20 increases in weight.

Figure 8:
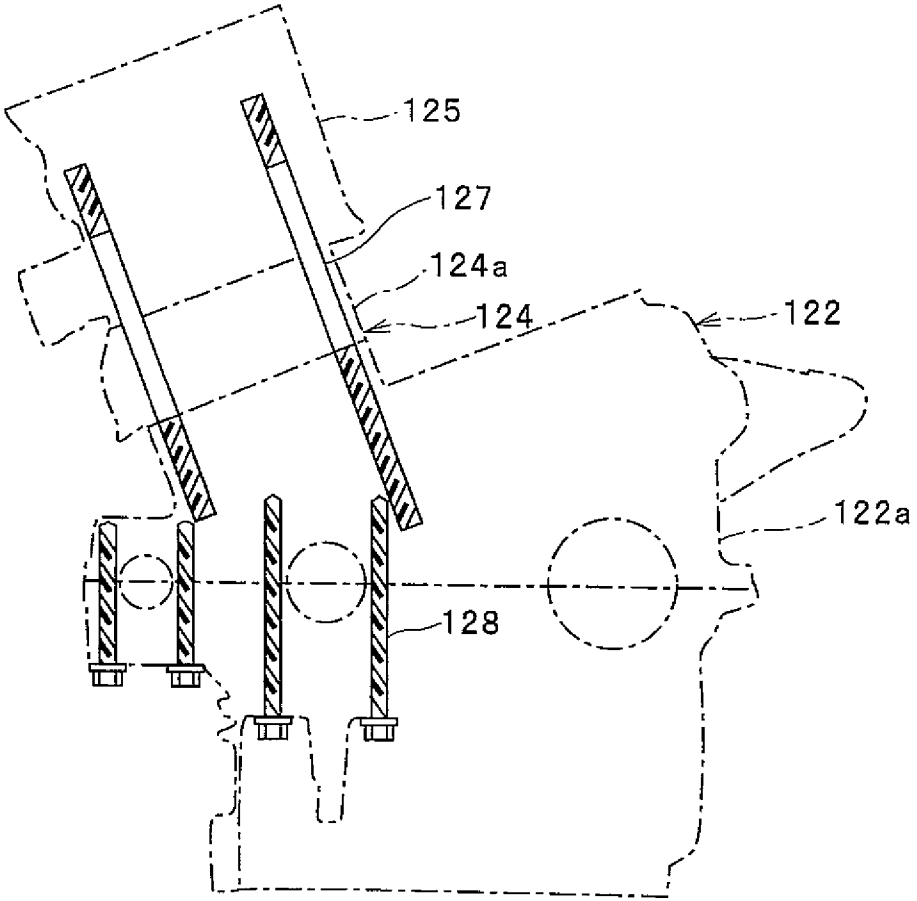
FIG. 8 is a schematic left side view of the engine in which a rear cylinder fixing bolt is overlapped with a casing fixing bolt in a vertical direction.
Figure 9:
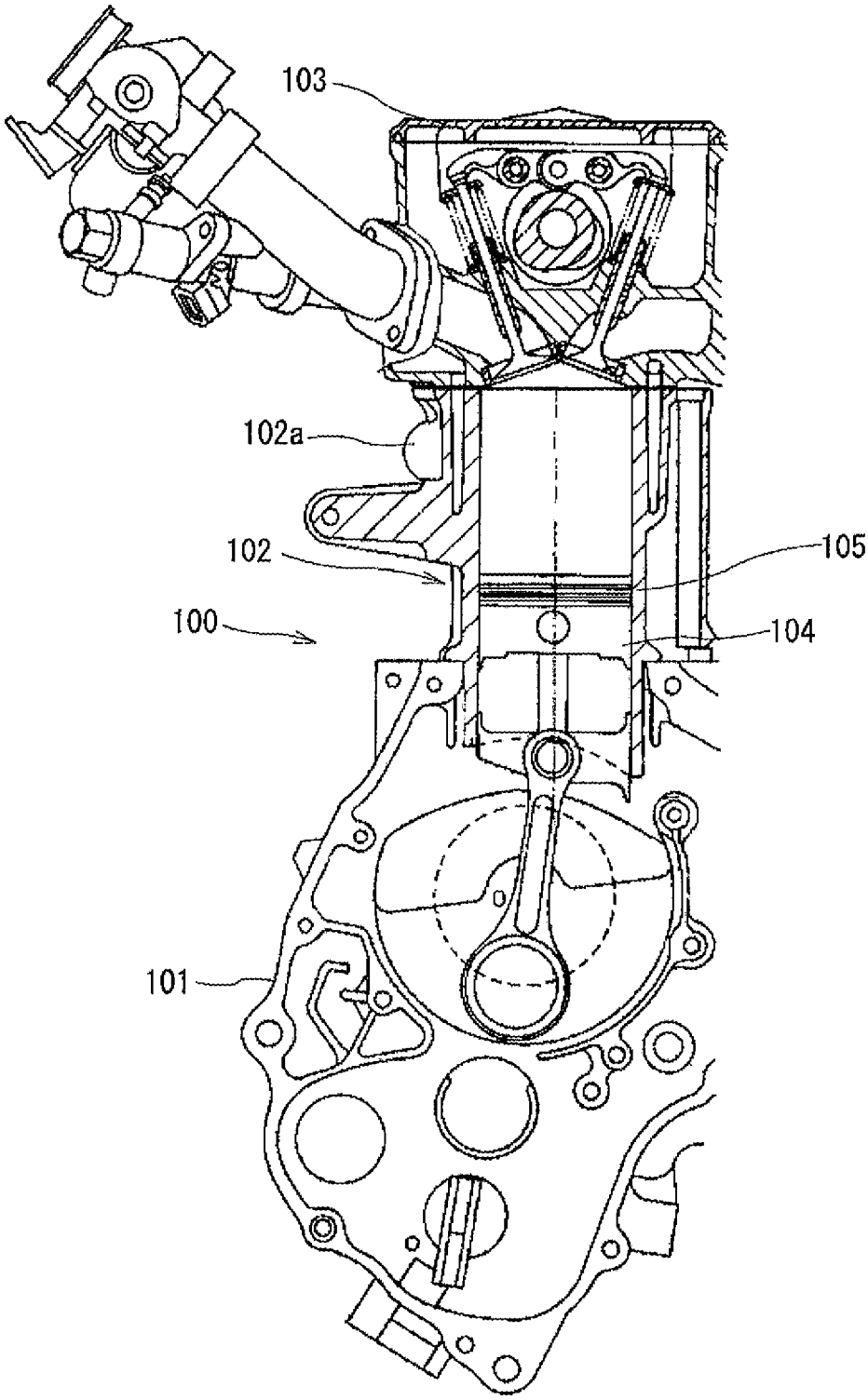
FIG. 9 PRIOR ART
FIG. 9 is a typical cross-sectional view of an engine of the related art.

Moreover, as shown in FIG. 8, it is considered that the rear cylinder fixing bolts 127 are extended downward and each cylinder fixing bolt 127 and each casing fixing bolt 128 are overlapped with each other to ensure rigidity of the crankcase 122. However, in this case, each cylinder fixing bolt 127 is made further longer and its weight is further increased. Accordingly, the weight of the engine 20 is possibly further increased.

According to the present embodiment, by contrast, the sliding section that belongs in the body cylinder 24 and slides with respect to the piston 30 is located within the crankcase 22 as shown in FIG. 4. Accordingly, a distance L1 between the seat surface 22*d* of the upper casing section 22*a* and the axis C of the crankshaft 21 is relatively long. A distance L2 between the lower end portion of each cylinder fixing bolt 27 and the upper end portion of each casing fixing bolt 28 can thereby be made relatively long. Accordingly, a stress applied onto a portion that belongs in the crankcase 22 and is located between the lower end portion of the cylinder fixing bolt 27 and the upper end portion of the casing fixing bolt 28 is reduced per unit volume. Therefore, there is no need to increase the thickness of the portion that belongs in the crankcase 22 and is located between the lower end portion of the cylinder fixing bolt 27 and the upper end portion of the casing fixing bolt 28, as compared with the case shown in FIG. 7. Moreover, it is unnecessary to vertically overlap each cylinder fixing bolt 27 with each casing fixing bolt 28 as shown in FIG. 8. The engine 20 can thus be further decreased in weight.

As shown in FIG. 6, in the present embodiment, the tapered section 26*h* is provided in the lower section 26*f* and is arranged toward the crankshaft 21 as compared with the piston ring 31 of the piston 30 located at the bottom dead center. Further, the tapered section 26*h* is thinner than the portion of the lower section 26*f* located toward the head cylinder 25 as compared with the piston ring 31 of the piston 30 located at the bottom dead center. The body cylinder 24 and the engine 20 are thereby even lighter in weight.

The tapered section 26*h* is located toward the crankshaft 21 as compared with the piston ring 31 of the piston 30 located at the bottom dead center. The rigidity required for the tapered section 26*h* is thereby not so high as that required for a portion that belongs in the lower section 26*f* and is located above the tapered section 26*h*. Moreover, the shape accuracy required for the tapered section 26*h* is lower than that required for the portion that belongs in the lower section 26*f* and is located above the tapered section 26*h*. Due to this, even if the tapered section 26*h* located toward the crankshaft 21 as compared with the piston ring 31 of the piston 30 located at the bottom dead center is made thinner, no serious problems occur.

The invention claimed is:

1. An engine comprising:

a crankcase;

a crankshaft accommodated in the crankcase;

a connecting rod connected to the crankshaft;

a piston connected to a tip end portion of the connecting rod;

a piston ring attached to an outer peripheral surface of the piston;

a body cylinder connected to the crankcase, and including a cylinder section inside of which the piston is displaced;

a head cylinder connected to a tip end portion of the body cylinder; and a cylinder fixing bolt having one end portion extending toward the head cylinder and an other end portion extending toward the crankcase, the cylinder fixing bolt connecting the head cylinder, the body cylinder and the crankcase to one another;

wherein the cylinder section includes:

a lower section located within the crankcase; and an upper section located at a higher position than a position of the crankcase;

wherein the piston ring abuts on the lower section when the piston is located at a bottom dead center; and wherein at least a part of a portion of the lower section of the cylinder section that is located toward the crankshaft as compared with the piston ring when the piston is located at the bottom dead center is thinner than a portion of the lower section that is located on an opposite side to the crankshaft with respect to the piston ring when the piston is located at the bottom dead center.

2. The engine according to claim 1, wherein the crankcase includes:

an upper casing section to which the body cylinder is connected; and a lower casing section connected to a lower side of the upper casing section, and the engine further comprises a casing fixing bolt for connecting the upper casing section to the lower casing section.

3. The engine according to claim 1, wherein a plurality of the cylinder sections are arranged in the body cylinder in an extension direction of the crankshaft.

4. A straddle-type vehicle comprising the engine according to claim 1.

5. An engine comprising:

a crankcase;

a crankshaft accommodated in the crankcase;

a connecting rod connected to the crankshaft;

a piston connected to a tip end portion of the connecting rod;

a piston ring attached to an outer peripheral surface of the piston;

a body cylinder connected to the crankcase, and including a cylinder section inside of which the piston is displaced;

a head cylinder connected to a tip end portion of the body cylinder; and a cylinder fixing bolt having one end portion extending toward the head cylinder and an other end portion extending toward the crankcase, the cylinder fixing bolt connecting the head cylinder, the body cylinder and the crankcase to one another;

wherein the cylinder section includes:

a lower section located within the crankcase; and an upper section located at a higher position than a position of the crankcase;

wherein the piston ring abuts on the lower section when the piston is located at a bottom dead center; and wherein a portion of the lower section of the cylinder section that is located toward the crankshaft as compared with the piston ring when the piston is located at the bottom dead center is a tapered section.

6. The engine according to claim 5, wherein the crankcase includes:

an upper casing section to which the body cylinder is connected; and a lower casing section connected to a lower side of the upper casing section, and the engine further comprises a casing fixing bolt for connecting the upper casing section to the lower casing section.

7. The engine according to claim 5, wherein a plurality of the cylinder sections are arranged in the body cylinder in an extension direction of the crankshaft.

8. A straddle-type vehicle comprising the engine according to claim 5.

9. An engine comprising:

a crankcase;

a crankshaft accommodated in the crankcase;

a connecting rod connected to the crankshaft;

a piston connected to a tip end portion of the connecting rod;

a piston ring attached to an outer peripheral surface of the piston;

a body cylinder connected to the crankcase, and including a cylinder section inside of which the piston is displaced;

a head cylinder connected to a tip end portion of the body cylinder; and a cylinder fixing bolt having one end portion extending toward the head cylinder and an other end portion extending toward the crankcase, the cylinder fixing bolt connecting the head cylinder, the body cylinder and the crankcase to one another;

the cylinder section including:

a lower section located within the crankcase; and an upper section located at a higher position than a position of the crankcase;

the piston ring abutting the lower section when the piston is located at a bottom dead center; and a substantially entire portion of the lower section of the cylinder section that is located toward the crankshaft as compared with the piston ring when the piston is located at the bottom dead center being thinner than a portion of the lower section that is located on an opposite side to the crankshaft with respect to the piston ring when the piston is located at the bottom dead center.

* * * * *